US007635003B2

(12) United States Patent
Lee

(10) Patent No.: US 7,635,003 B2
(45) Date of Patent: Dec. 22, 2009

(54) DISHWASHER AND CONTROLLING METHOD THEREOF

(75) Inventor: Jhe Hyouk Lee, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 624 days.

(21) Appl. No.: 11/373,998

(22) Filed: Mar. 14, 2006

(65) Prior Publication Data

US 2006/0207632 A1 Sep. 21, 2006

(30) Foreign Application Priority Data

Mar. 19, 2005 (KR) ..... 10-2005-0022951

(51) Int. Cl.
*B08B 7/04* (2006.01)
*B08B 3/00* (2006.01)

(52) U.S. Cl. ..... 134/25.2; 134/18; 134/56 D; 134/57 D; 134/58 D; 134/184; 134/186

(58) Field of Classification Search ..... 134/18, 134/25.2, 56 D, 57 D, 58 D, 184, 186
See application file for complete search history.

(56) References Cited

U.S. PATENT DOCUMENTS 5,168,885 A * 12/1992 Tromblee et al. ..... 134/105
5,779,812 A 7/1998 Thies et al.
2004/0159337 A1* 8/2004 Johnson et al. ..... 134/18

FOREIGN PATENT DOCUMENTS

| | | | |
|---|---|---|---|
| DE | 29823869 | * | 1/2000 |
| DE | 29823869 U1 | | 2/2000 |
| EP | 1029497 | * | 8/2000 |
| EP | 1029497 A2 | | 8/2000 |

* cited by examiner

*Primary Examiner*—Michael Barr
*Assistant Examiner*—Saeed T Chaudhry
(74) *Attorney, Agent, or Firm*—McKenna Long & Aldridge LLP

(57) ABSTRACT

A dishwasher is provided. The dishwasher includes a sump, a wash motor, a disposer, a screen filter, and a drain motor. The sump stores wash liquid. The wash motor pumps the wash liquid stored in the sump. The disposer is installed inside the sump and connected to the wash motor by a motor shaft. The screen filter is installed inside the sump to prevent impurities ground by a rotation of the disposer from entering a wash pump. The drain motor discharges the wash liquid stored in the sump to an outside. The wash motor operates for a predetermined duration during a draining process performed by an operation of the drain motor.

9 Claims, 7 Drawing Sheets

DISHWASHER AND CONTROLLING METHOD THEREOF

This application claims priority to Korean Application 10-2005-022951, filed on Mar. 19, 2005, which is incorporated by reference, as if fully set forth herein.

BACKGROUND OF THE INVENTION

1. Field of the Invention

The present invention relates to a dishwasher, and more particularly, to a dishwasher capable of cleaning a screen filter thereof, and a controlling method of the dishwasher.

2. Description of the Related Art

A dishwasher is a home appliance that sprays wash liquid (that flows by means of a wash pump) from nozzles onto upper and lower racks, to wash dishes placed on the racks.

Specifically, a dishwasher includes a tub forming a wash compartment, a dish rack disposed inside the tub for storing dishes, a spray nozzle for spraying wash liquid onto the surface of dishes, and a sump installed at the bottom of the tub for storing wash liquid.

Installed inside the sump are a wash pump that pumps wash liquid under high pressure and a wash motor for driving the wash pump.

The dishwasher also includes a water guide connected to the sump to provide a passage for the flow of wash liquid, an upper spray arm branching off from a portion of the water guide to be disposed in the approximate central portion of the tub, and a top nozzle formed at the top portion inside the tub.

In a dishwasher according to the related art, high-pressure wash liquid sprayed from the upper spray arm and top nozzle causes food residue and other impurities on the surfaces of dishes to be removed and fall to the floor of the tub, whereupon the fallen impurities enter the sump.

A self-cleaning filter for filtering impurities is installed at the top of the sump, to prevent impurities of a large size from entering the inside of the sump.

A disposer is installed within the sump to grind impurities that enter the sump into small particles, and a screen filter is provided to prevent the small particles ground by the disposer from entering the wash pump.

In this way, clogging of the passages (through which wash liquid flows to the spray arm and nozzle) by the impurities is prevented by grinding the impurities that enter the sump.

In order to prevent the holes in the screen filter from being clogged by the impurities, the disposer rotates at around 3300-3400 rpm.

However, when the disposer rotates during dishwasher operation, a grinding noise created by the disposer rotating against the screen filter can be disconcerting to a user.

Also, rotation of the disposer may be insufficient to remove impurity particles stuck in the screen filter, so that the impurities accumulate on the screen filter and hinder the flow of wash liquid.

SUMMARY OF THE INVENTION

Accordingly, the present invention is directed to a dishwasher and a controlling method thereof that substantially obviate one or more problems due to limitations and disadvantages of the related art.

An object of the present invention is to provide a dishwasher and a controlling method thereof that prevent noise created by the rotation of a disposer.

Another object of the present invention is to provide a dishwasher and a controlling method thereof that remove impurities stuck in a screen filter during the draining of wash liquid, so that the screen filter is cleaned.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dishwasher including: a sump for storing wash liquid; a wash motor for pumping the wash liquid stored in the sump; a disposer installed inside the sump and connected to the wash motor by a motor shaft; a screen filter installed inside the sump for preventing impurities ground by a rotation of the disposer from entering a wash pump; and a drain motor for discharging the wash liquid stored in the sump to an outside, wherein the wash motor operates for a predetermined duration during a draining process performed by an operation of the drain motor.

In another aspect of the present invention, there is provided a controlling method of a dishwasher including temporarily operating a wash motor during a draining process when wash liquid stored in a sump is discharged to an outside through an operation of a drain motor.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
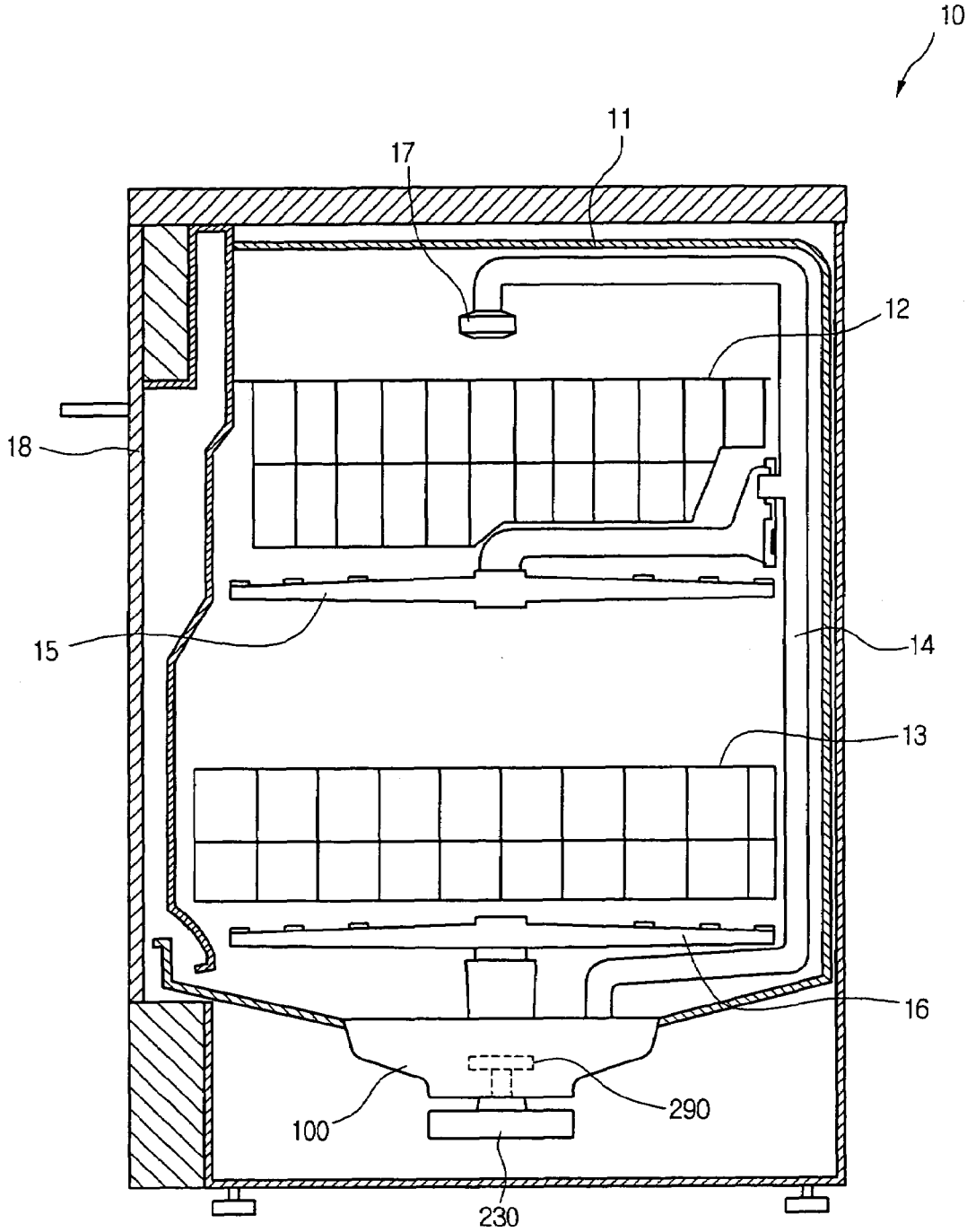
FIG. 1 is a sectional view of a dishwasher according to an embodiment of the present invention.

FIG. 1 is a sectional view of a dishwasher according to an embodiment of the present invention.

Referring to FIG. 1, a dishwasher 10 according to the present invention includes a tub 11 forming the outer shape of the dishwasher 10 and a wash compartment within, a door 18 formed at the front of the tub 11 for opening and closing the wash compartment, and a sump 100 formed at a central bottom portion of the tub 11 for storing wash liquid within.

Additionally, the dishwasher 10 includes a wash motor 230 attached to the bottom end thereof for driving a wash pump 290 disposed inside the sump 100, a water guide 14 providing a passage for wash liquid pumped by the wash pump 290, a lower spray arm 16 coupled to the top of the sump 100 for spraying wash liquid within the wash compartment in an upward and/or downward direction, an upper spray arm 15 attached at a portion of the water guide 14 to extend horizontally therefrom to be centrally disposed inside the tub 11, and a top nozzle 17 connected to the top end of the water guide 14 and disposed on the ceiling of the tub 11 to spray wash liquid in a downward direction.

Additionally, the dishwasher 10 includes an upper rack 12 installed directly above the upper spray arm 15, and a lower rack 13 installed directly above the lower spray arm 16.

In further detail, dishes stored in the upper rack 12 are washed by wash liquid sprayed from the upper spray arm 15 and top nozzle 17. Dishes stored in the lower rack 13 are washed by wash liquid sprayed from the lower spray arm 16.

The operation of the above dishwasher 10 according to the present invention will now be described.

First, a user opens the door 18 of the dishwasher 10, pulls the upper and/or lower racks 12 and 13 out, and places dishes in the upper rack 12 and/or lower rack 13. The door 18 is then closed, and a wash cycle is activated, by pressing a start button.

When the start button of the dishwasher 10 is pressed to begin a wash cycle, wash liquid enters the sump 100 from a water supply by means of an opening valve. After a predetermined amount of wash liquid enters the sump 100, the wash motor 230 operates. An impeller (150 in FIG. 2), connected to a shaft of the wash motor 230 and disposed inside the wash pump 290, rotates to pump wash liquid to the lower spray arm 16 and the water guide 14.

The wash liquid pumped to the water guide 14 ultimately flows to the top nozzle 17 and the upper spray arm 15 to be sprayed therefrom into the wash compartment. The sprayed wash liquid washes dishes placed in the racks 12 and 13.

Here, the top nozzle 17 sprays wash liquid in a vertically downward direction and the upper spray arm 15 sprays wash liquid in a vertically upward direction to wash dishes placed in the upper rack 12.

The lower spray arm 16 sprays wash liquid in a vertically upward direction to wash dishes placed in the lower rack 13. Additionally, the upper spray arm 15 may have spray holes also formed at the bottom thereof to spray wash liquid in both upward and downward directions, to wash the tops of dishes placed in the lower rack 13 at the same time.

Impurities washed from dishes during a wash cycle are removed by means of a filter (not shown) provided in the sump 100, and are ground into small particles by a food processor (to be described below) installed inside the sump 100. The disposer is installed a predetermined distance apart from a screen filter (to be described below) within the sump 100, so that noise from the rotation of the disposer is reduced.

After the wash cycle is completed, dirty wash liquid containing impurities is dispelled to the outside of the dishwasher 10 by means of a drain pump (not shown). Here, in order to dispel the impurities that are lodged in the screen filter along with the draining wash liquid, the wash motor 230 operates for a predetermined period during the draining process. The temporary operation of the wash motor 230 in the draining process abruptly lowers the water level of the wash liquid, so that the impurities lodged in the screen filter are dispelled along with the drained wash liquid.

The above process will be described later in further detail with reference to the diagrams.

After the wash liquid is dispelled to the outside, fresh wash liquid enters the sump 100 through an inlet, whereupon the wash liquid is sprayed through the spray arms 15 and 16 in the same manner as in the wash cycle. The clean, sprayed wash liquid rinses the dishes in a rinse cycle. When the rinse cycle is completed, a drying cycle is implemented to complete the dishwashing process.

Figure 2:
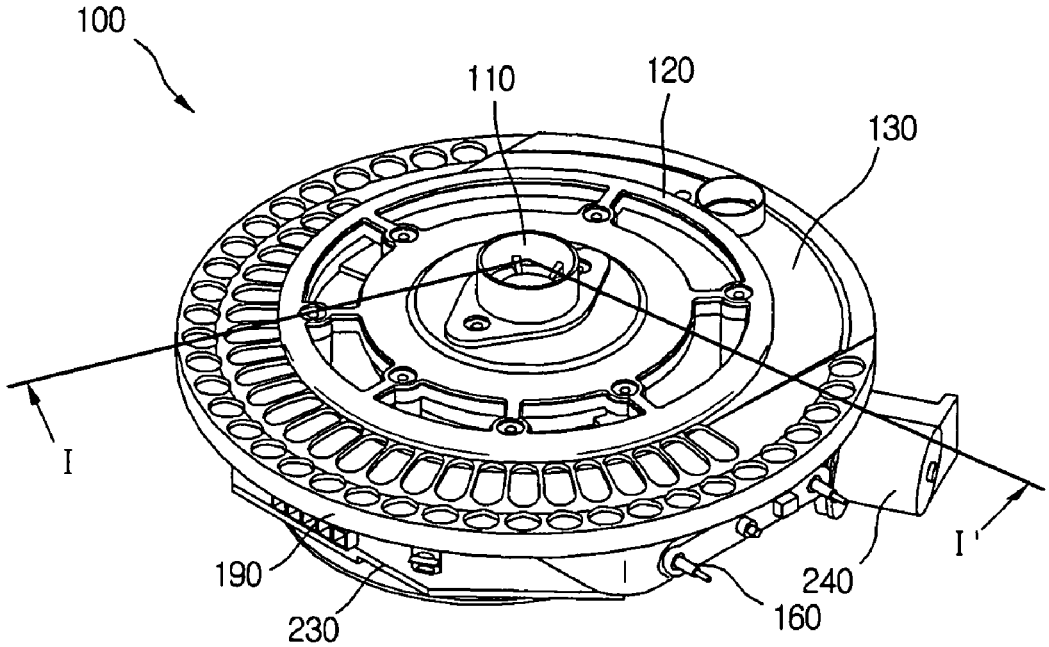
FIG. 2 is a perspective view of a sump of a dishwasher according to the present invention.
Figure 3:
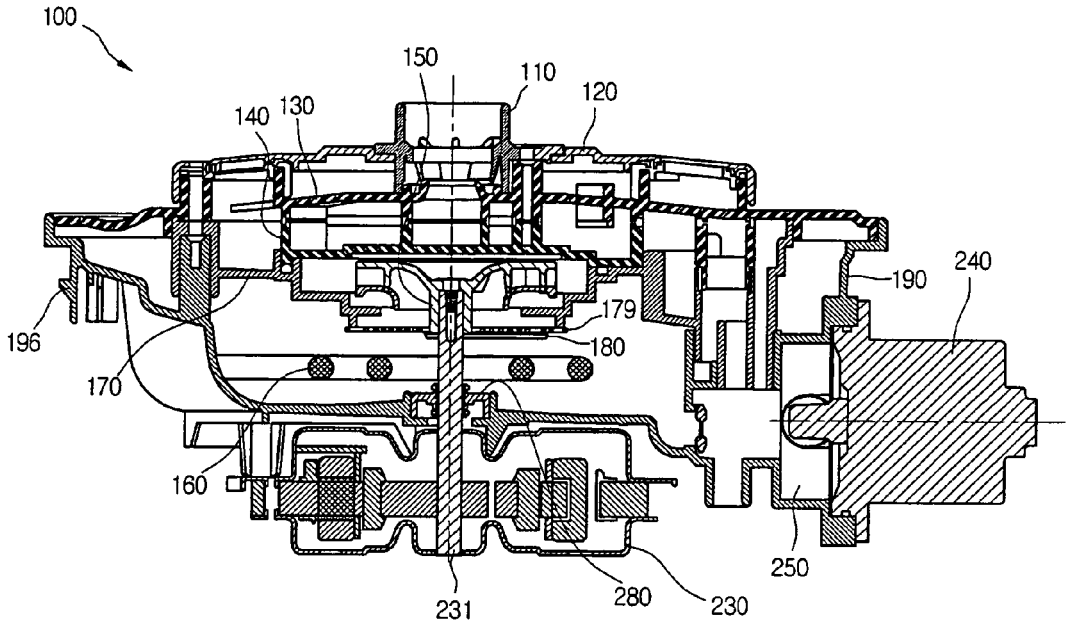
FIG. 3 is a sectional view of the sump in FIG. 2 taken along lines I-I'.

FIG. 2 is a perspective view of a sump of a dishwasher according to the present invention, and FIG. 3 is a sectional view of the sump in FIG. 2 taken along lines I-I'.

Referring to FIGS. 2 and 3, the sump 100 according to the present invention includes: a sump case 190 disposed at a lowermost end thereof for storing wash liquid within, a sump cover 130 that covers the upper surface of the sump case 190, a self-cleaning filter 120 stepped a predetermined height from and mounted on the top surface of the sump cover 130, a lower spray arm holder 110 mounted on the central portion of the self-cleaning filter 120 and connected to the lower spray arm 16, a wash motor 230 installed at the bottom of the sump case 190 for imparting rotational force, and a drain pump 250 and a drain motor 240 installed on a side of the sump case 190 for draining wash liquid to the outside.

The sump 100 further includes: a heater 160 installed at the inner floor of the sump case 190 for heating wash liquid, a disposer 180 connected to the motor shaft 231 of the wash motor 230 to rotate integrally with the motor shaft 231 and pulverize food residue, a pump lower unit 170 mounted to the upper surface of the sump case 190 and including a soil chamber for collecting food residue, a guide passage 140 mounted between the sump cover 130 and the pump lower unit 170, a wash pump 290 formed between the sump lower unit 170 and the guide passage 140 for pumping wash liquid, and a screen filter 179 installed between the pump lower unit 170 and the disposer 180 for preventing impurities pulverized by the disposer 180 from entering the wash pump 290.

In further detail, the screen filter 179, being a filter with a plurality of small holes formed therein for filtering food residue, is attached to the bottom of the sump lower unit 170.

The disposer 180, as shown in FIG. 3, is installed a predetermined distance apart from the screen filter 179 to prevent friction being created between the disposer 180 and the screen filter 179. The disposer 180 is connected to the motor shaft 231 of the wash motor 230, so that it rotates according to the operation of the wash motor 230.

The wash pump 290 is provided in the central portion of the pump lower unit 170, and includes an impeller 150 that is connected to and rotates integrally with the motor shaft 231. The impeller 150, being connected to rotate with the motor shaft 231, suctions wash liquid into the sump case 190, and discharges wash liquid to the outside of the pump. Additionally, a passage is formed at the upper surface of the guide passage 140 for guiding wash liquid pumped by the wash pump 290 to the water guide or lower spray arm.

The operation of the sump 100 according to the present invention will now be described.

First, when a wash cycle begins, wash liquid flows into the sump case 190 from a water supply device, and the wash motor 230 operates to rotate the impeller 150. When the impeller 150 rotates, wash liquid enters the sump 100 and flows through a passage opened by a vario valve to the water guide 14 or the lower nozzle holder 110.

Wash liquid is pumped at high pressure by the wash pump 290 driven by the wash motor 230, and is sprayed onto dishes from the upper and lower spray arms and the top nozzle 15, 16, and 17.

While the dishes are being washed, the disposer 180 is driven by the wash motor 230 to rotate and grind impurities that enter the sump 100.

The impurities ground by the disposer 180 are prevented from entering the wash pump 290 by the screen filter 180.

After the wash cycle performed with the operating wash motor 230 is completed, the contaminated wash liquid that collects in the sump 100 is discharged outside the dishwasher 10 through the operation of the drain motor 240.

Here, a predetermined control unit (to be described below) clocks the operating time of the drain motor 240 while calculating the water level of the draining wash liquid. When the water level of the draining wash liquid is deemed to be at a predetermined height with respect to the screen filter 179, the wash motor 230 is operated for a predetermined duration. In the case where a water level sensor (not shown) for sensing the water level of wash liquid in the sump 100 is installed, the control unit can derive the water level of wash liquid from a value provided by the water level sensor.

Accordingly, the water level of the wash liquid is lowered quickly so that the wash liquid removes the impurities lodged in the screen filter 179 in a downward direction. This process will be described further below with reference to the diagrams.

As described above, because the disposer 180 is installed a predetermined distance from the screen filter 179, the rotation of the disposer 180 will not cause it to scrape against the screen filter 179.

After the draining process of the contaminated wash liquid is completed, fresh wash liquid may be drawn into the sump 100, whereupon it may undergo the same cycle as in the wash cycle to perform a rinse cycle.

Figure 4:
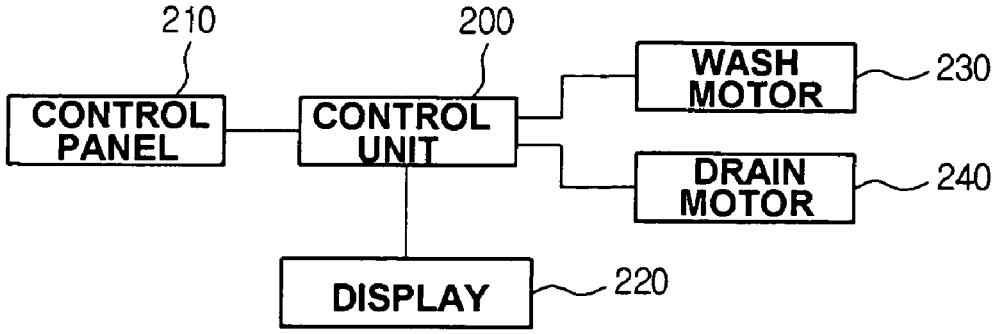
FIG. 4 is a block diagram of components of a dishwasher according to an embodiment of the present invention.
Figure 5:
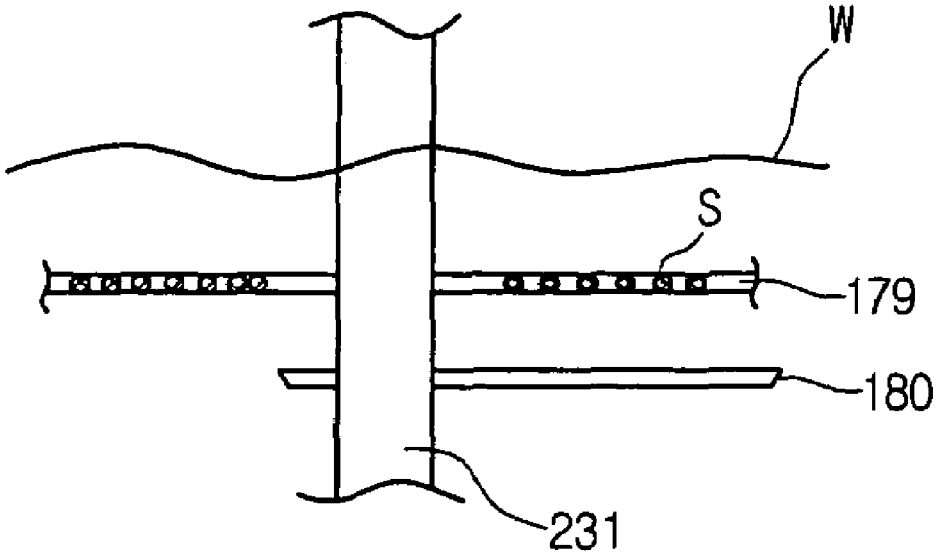
FIG. 5 is a diagram showing the water level of wash liquid during a draining process.
Figure 6:
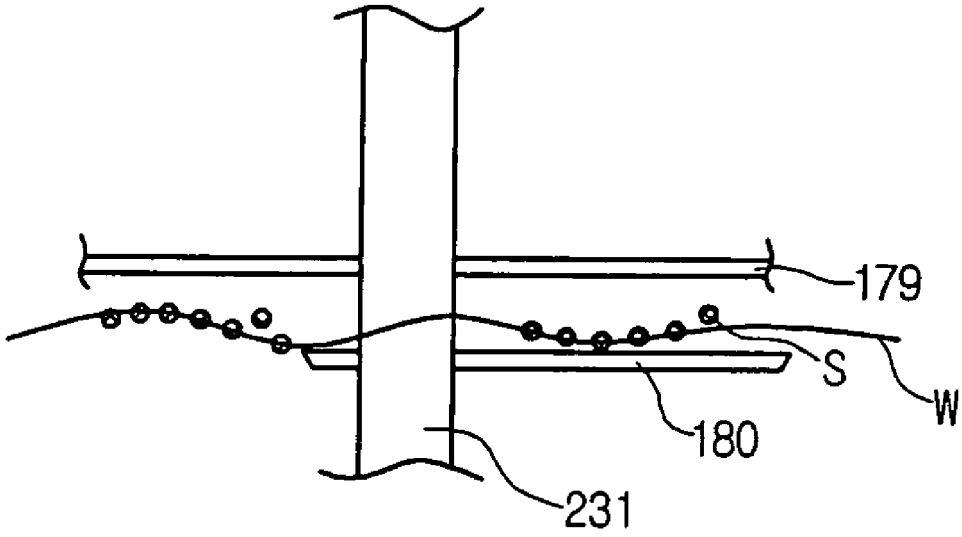
FIG. 6 is a diagram showing the removal of impurities stuck in a screen filter according to the operation of a wash motor.

FIG. 4 is a block diagram of components of a dishwasher according to an embodiment of the present invention, FIG. 5 is a diagram showing the water level of wash liquid during a draining process, and FIG. 6 is a diagram showing the removal of impurities stuck in a screen filter according to the operation of a wash motor.

Referring to FIGS. 4 through 6, a dishwasher according to an embodiment of the present invention includes a control panel 210 in which a user can input wash course settings, a control unit 200 for controlling the operation of a wash course according to the inputted settings, a wash motor 230 for operating according to a control signal from the control unit 200, and a drain motor 240.

The dishwasher also includes a display 220 that is connected to the control unit 200, for displaying the operating of the wash course.

In further detail, the control unit 200 operates the wash motor 230 and the drain motor 240 according to wash course settings inputted through the control panel 210.

When the wash motor 230 operates, wash liquid stored inside the sump 100 is pumped at high pressure, and is sprayed from the spray arms and nozzle to wash dishes. When the wash motor 230 operates, the disposer 180 that is attached to the shaft of the wash motor 230 rotates to grind impurities into small pieces.

The wash course may be ended when the wash motor 230 ceases operation.

When the drain motor 240 operates, contaminated wash liquid inside the sump 100 may be discharged to the outside. In this case, the control unit 200 clocks the operation of the drain motor 240, and temporarily operates the wash motor 230 if the operation of the drain motor 240 reaches a preset duration.

After the control unit 200 performs a pre-wash and a main wash cycle of dishes stored in the dishwasher, it operates the wash motor 230 for a predetermined duration during the draining to the outside of the wash liquid that was used to wash the dishes.

By clocking the operation of the drain motor 240, the control unit 200 can calculate the water level of the draining wash liquid.

If the operating time of the drain motor 240 reaches a preset time, the control unit 200 determines that the water level (W) of the wash liquid is at a predetermined height with respect to the screen filter 179.

Here, the control unit 200 temporarily operates the wash motor 230 so that the water level (W) of the wash liquid can be rapidly lowered.

In other words, the control unit 200 operates the wash motor 230 for a predetermined duration during a draining cycle so that a portion of the wash liquid being drained is sprayed through the spray arms and nozzle installed in the tub, thereby performing a temporary wash cycle during the draining cycle.

The operation of the wash motor 230 during the draining cycle rotates the motor shaft 231 of the wash motor 230, thus rotating the disposer 180 as well.

The water level (W) of the wash liquid falls rapidly due to the operation of the wash motor 230, to remove impurities (S) lodged in the screen filter 179.

The removed impurities (S) may be cut into smaller pieces by the rotating disposer 180.

When the wash motor 230 temporarily operates during the draining cycle performed by the drain motor 240, the control unit 200 may display a predetermined message through the display 220.

As described above, due to the impurities lodged in the screen filter 180 being discharged in the draining process, a reduction in the performance of the dishwasher caused by impurity-induced clogs can be prevented.

Figure 7:
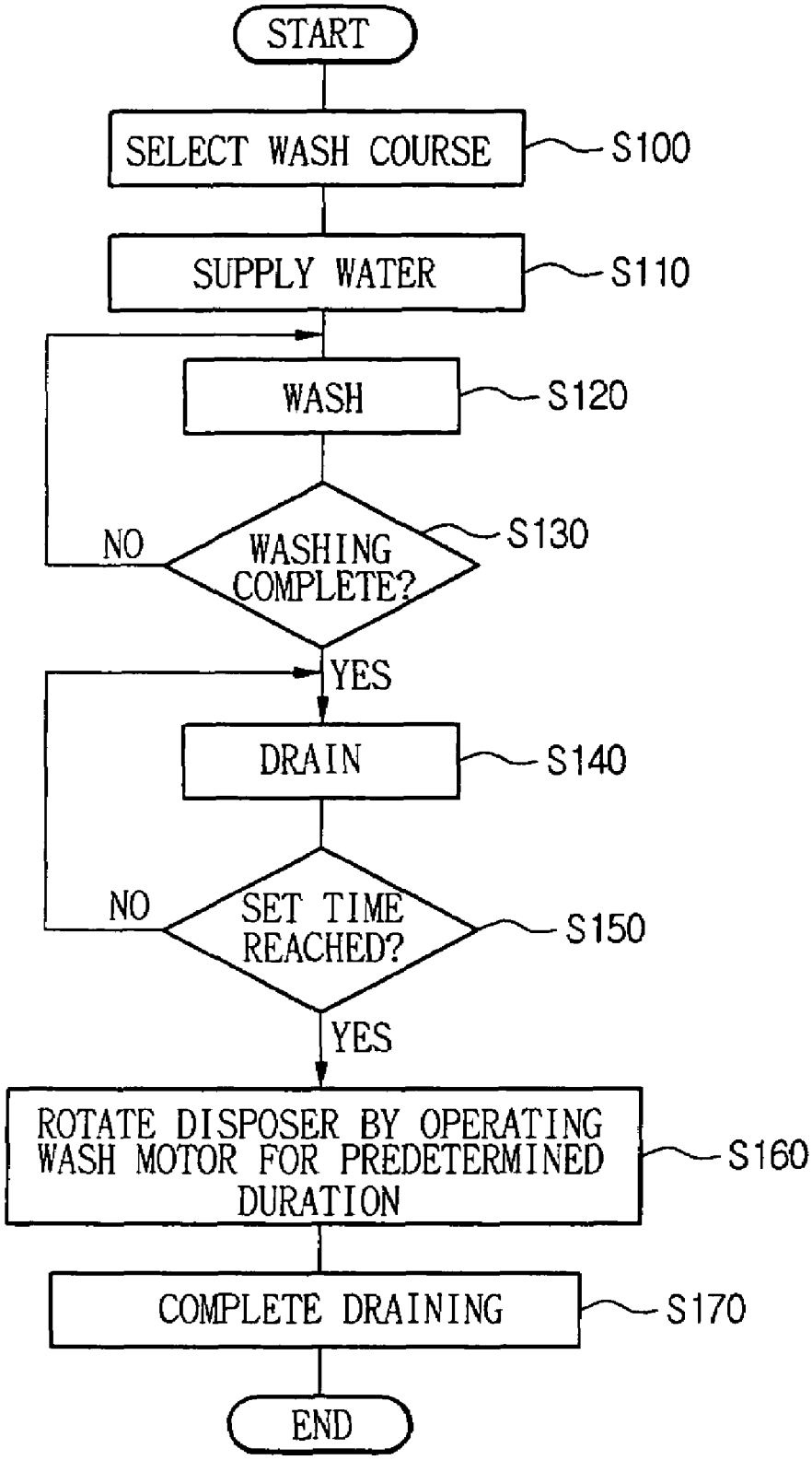
FIG. 7 is a flowchart of a controlling method for a dishwasher according to an embodiment of the present invention.

FIG. 7 is a flowchart of a controlling method for a dishwasher according to an embodiment of the present invention.

First, a user inputs wash settings in step S100 through the control panel 210, and wash liquid flows into the sump 100 in step S110.

Then, the stored wash liquid is pumped at high pressure by the operating wash motor 230, whereupon the pumped wash liquid is sprayed from the spray arms and nozzle to wash dishes stored in the dishwasher in a wash cycle in step S120.

Next, the wash cycle performed by the wash motor 230 is completed in step S130, and a draining cycle for draining the wash liquid that was contaminated during the wash cycle is performed in step S140.

In this case, the draining of the wash liquid is performed by the operation of the drain motor 240, and the control unit 200 clocks the operation of the drain motor 240.

The control unit determines in step S150 if the operation of the drain motor 240 reaches a preset time. If the operating time of the drain motor 240 reaches the preset time, the control unit 200 operates the wash motor 230 for a predetermined duration in step S160, so that the disposer 180 rotates.

Accordingly, the water level of the wash liquid being drained declines sharply to remove impurities lodged in the screen filter 179.

After the wash motor 230 is operated for a predetermined duration during the draining process, the wash motor 230 is stopped, and the remaining wash liquid is drained completely by the drain motor 240 in step S170.

In the above-described embodiments, friction between the screen filter and the disposer is eliminated, and impurities lodged in the screen filter can be removed with the receding water level of wash liquid.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dishwasher comprising:

a sump for storing wash liquid;

a wash motor for pumping the wash liquid stored in the sump;

a disposer installed inside the sump and connected to the wash motor by a motor shaft;

a screen filter installed inside the sump, for preventing impurities ground by a rotation of the disposer from entering a wash pump;

a drain motor for discharging the wash liquid stored in the sump to an outside; and a control unit for controlling an operation of the wash motor and the drain motor, wherein the drain motor starts a drain operation after the wash motor is stopped, and the wash motor is operated for a predetermined duration when an operation time of the drain motor reaches a set time.

2. The dishwasher according to claim 1, wherein the control unit clocks the operation time of the drain motor.

3. The dishwasher according to claim 1, further comprising a display for displaying an operation of the dishwasher, the display displaying a predetermined message when the wash motor operates for the predetermined duration while the draining process is performed by the operation of the drain motor.

4. A dishwasher comprising:

a sump for storing wash liquid;

a wash motor for pumping the wash liquid stored in the sump;

a disposer installed inside the sump and connected to the wash motor through a motor shaft;

a screen filter installed inside the sump, for preventing impurities ground by a rotation of the disposer from entering a wash pump;

a drain motor for discharging the wash liquid stored in the sump to an outside; and a control unit for controlling an operation of the wash motor and the drain motor, wherein the drain motor is operated by the control unit after the wash motor is stopped, and the wash motor is temporarily operated with the drain motor when a water level of the wash liquid in the sump reaches a predetermined height with respect to the screen filter, and the water level is calculated by using an operation time of the drain motor clocked by the control unit.

5. The dishwasher according to claim 4, wherein the disposer is rotated through the temporary operation of the wash motor to dislodge impurities stuck in the screen filter.

6. The dishwasher according to claim 4, wherein the control unit displays a predetermined message on a predetermined display during the operation of the wash motor.

7. A controlling method of a dishwasher comprising:

inputting a wash course through a control panel, and drawing wash liquid into a sump;

pumping by a wash motor of the wash liquid drawn into the sump to perform washing of stored dishes;

discharging wash liquid stored in the sump to an outside by operating a drain motor when the washing is completed by stopping of the wash motor;

clocking the operation of the drain motor by a control unit; and operating the wash motor for a predetermined duration by the control unit when the clocked time reaches a set time.

8. The controlling method according to claim 7, wherein the operating of the wash motor for the predetermined duration includes a rotating of a disposer attached to a motor shaft of the wash motor according to the operating of the wash motor, and the rotating of the disposer removes impurities lodged in a predetermined screen filter.

9. The controlling method according to claim 7, wherein the operating of the wash motor for the predetermined duration includes displaying a predetermined message on a predetermined display.

* * * * *